US007186910B2

(12) United States Patent
Sakurai et al.

(10) Patent No.: US 7,186,910 B2
(45) Date of Patent: Mar. 6, 2007

(54) MUSICAL TONE GENERATING APPARATUS AND MUSICAL TONE GENERATING COMPUTER PROGRAM

(75) Inventors: Yasushi Sakurai, Hamamatsu (JP); Thomas Koritke, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 164 days.

(21) Appl. No.: 10/383,836

(22) Filed: Mar. 7, 2003

(65) Prior Publication Data

US 2003/0172799 A1 Sep. 18, 2003

(30) Foreign Application Priority Data

Mar. 12, 2002 (JP) ..... 2002-066486

(51) Int. Cl.
*G10H 7/00* (2006.01)

(52) U.S. Cl. ..... 84/622; 84/626

(58) Field of Classification Search ..... 84/622, 84/626, 659, 661

See application file for complete search history.

(56) References Cited

U.S. PATENT DOCUMENTS

| | | | | |
|---|---|---|---|---|
| 4,681,008 | A | 7/1987 | Morikawa et al. | |
| 5,451,710 | A * | 9/1995 | Shimizu | 84/622 |
| 5,712,438 | A | 1/1998 | Nakata | |
| 6,169,240 | B1 | 1/2001 | Suzuki | |
| 6,274,799 | B1 | 8/2001 | Shimizu | |
| 6,284,964 | B1 | 9/2001 | Suzuki et al. | |

FOREIGN PATENT DOCUMENTS

| | | |
|---|---|---|
| JP | 63-62759 | 12/1988 |
| JP | 10-340081 | 12/1998 |
| JP | 2001-100744 | 1/2001 |

OTHER PUBLICATIONS

Roland, RS-PCM Keyboard U-20, Owner's Manual, Jun. 8, 1999, pp. 60-61, 85 and 160-162.

* cited by examiner

*Primary Examiner*—Jeffrey W Donels
(74) *Attorney, Agent, or Firm*—Morrison & Foerster LLP

(57) ABSTRACT

A plurality of play style dependence tone colors belonging to one kind of musical instrument tone color but being different from one another in terms of play styles are respectively assigned to different values of velocity and note number. For example, play style dependence tone colors such as open soft and open middle of a steel guitar are assigned to tone pitch ranges C2 to B5, and the play style dependence tone colors are respectively assigned to different velocity values. Play style dependence tone colors such as strumming and fret noise of a steel guitar are assigned to tone pitch ranges C6 to G8, and the play style dependence tone colors are respectively assigned to different note number values. By setting the note number and velocity values in note-on event data in various ways, musical tone signals of various play style dependence tone colors are generated even if the program change and bank select data are not changed. This provides shorter processing time needed for switching among tone colors of different play styles, and also the work of editing the performance data or the like including the switching of the tone colors can be performed easily and accurately.

24 Claims, 7 Drawing Sheets

MUSICAL TONE GENERATING APPARATUS AND MUSICAL TONE GENERATING COMPUTER PROGRAM

BACKGROUND OF THE INVENTION

1. Field of the Invention

The present invention relates to a musical tone generating apparatus that generates a musical tone signal of a desired tone color in accordance with a performance data as well as to a musical tone generating computer program for generating the musical tone signal.

2. Description of the Background Art

Hitherto, in order to select a tone color of a musical tone signal generated in an electronic musical instrument, one makes use of a special tone color selection data for selecting a tone color. This tone color selection data belongs to one kind of performance event data together with a note-on event data and a note-off event data, and is made of a bank select data and a program change data. However, these tone colors correspond to tone colors of one kind of musical instrument such as a steel guitar and an electric guitar, so that different tone colors being different from one another in terms of play styles in one and the same musical instrument are not differentiated.

In recent years, selection among different tone colors being different from one another in terms of play styles is desired, and a method therefor is disclosed, for example, in Japanese Laid-open Patent Publication No. 10-214083/1998. In this case, for tone colors of a guitar, sampling waveform data of guitar sounds in various styles of playing such as normal playing, mute playing, and glissando playing are respectively stored in different storage areas of a waveform memory as normal waveform data, mute waveform data, glissando waveform data, and the like in correspondence with the bank select data and the program change data. In order to select among these different waveform data being different from one another in terms of play styles, the bank select data and the program change data are inserted into the performance data, whereby the normal waveform data, the mute waveform data, the glissando waveform data, and the like are read out from the waveform data memory and reproduced by means of the bank select data and the program change data at the time of reproducing the performance data.

However, in the aforementioned conventional apparatus, if one wishes to generate musical tone signals of different tone colors belonging to one kind of musical instrument tone color and being different from one another in terms of play styles, the bank select data or the program change data must be selected every time and bank select processing or program change processing must be executed. Indeed, since the generation of such musical tone signals of different tone colors being different from one another in terms of play styles frequently takes place (in some cases, tone colors are switched for each musical note), the process of switching the tone colors disadvantageously consumes time. Also, the bank select data and the program change data for selection among different tone colors belonging to one kind of musical instrument tone color and being different from one another in terms of play styles constitute event data different from the note-on event data, thereby raising problems such as cumbersome labor or errors in the work of editing the performance data.

The present invention has been made in order to solve the aforementioned problems of the prior art, and an object thereof is to provide a musical tone generating apparatus and a musical tone generating computer program that provide shorter processing time needed for switching among tone colors of different play styles, and also allows the work of editing the performance data or the like including the switching of the tone colors to be performed easily and accurately.

SUMMARY OF THE INVENTION

The first characteristic feature of the present invention lies in that a musical tone generating apparatus is provided with a parameter memory that stores plural sets of musical tone generating parameters for respectively generating musical tone signals of plural kinds of play style dependence tone colors being different from one another in terms of play styles in one kind of musical instrument, and the plural kinds of play style dependence tone colors are respectively assigned to different values of velocity data, wherein a musical tone signal generation controlling portion inputs a first performance data that includes a note number data representing a tone pitch of a musical tone signal and a velocity data representing a tone volume level of the musical tone signal for giving instructions for generation of the musical tone signal, and controls reading one set of musical tone generating parameters corresponding to a play style dependence tone color that is assigned to a value of the velocity data in the input first performance data from the parameter memory and supplying the read one set of musical tone generating parameters to a musical tone signal generating circuit, so as to allow the musical tone signal generating circuit to generate a musical tone signal of the play style dependence tone color corresponding to the read one set of musical tone generating parameters.

The first characteristic feature of the present invention also lies in that the parameter memory stores plural sets of musical tone generating parameters for respectively generating musical tone signals of plural kinds of play style dependence tone colors for each of plural kinds of musical instrument tone colors, and the musical tone signal generation controlling portion also inputs a second performance data for selecting any one kind of musical instrument tone color from among plural kinds of musical instrument tone colors respectively corresponding to plural kinds of musical instruments in addition to the first performance data, and controls reading one set of musical tone generating parameters corresponding to a play style dependence tone color that belongs to a musical instrument tone color designated by the input second performance data and is assigned to a value of the velocity data in the input first performance data from the parameter memory and supplying the read one set of musical tone generating parameters to the musical tone signal generating circuit, so as to allow the musical tone signal generating circuit to generate a musical tone signal of the play style dependence tone color corresponding to the read one set of musical tone generating parameters.

According to these first characteristic features, musical tone signals of plural kinds of play style dependence tone colors being different from one another in terms of play styles in one and the same kind of musical instrument can be generated simply by setting the velocity data in the first performance data to various values. This eliminates the need for using the bank select data and the program change data, thereby providing shorter processing time needed for switching among the play style dependence tone colors. Also, this simplifies the work of editing the performance data including designation of a play style dependence tone color, and prevents occurrence of errors in the editing work.

Further, in the aforesaid first characteristic feature of the present invention, it is preferable that, in assigning plural kinds of play style dependence tone colors to the velocity data, the values of the velocity data are divided into plural ranges including plural different values, and different play style dependence tone colors are respectively assigned to the divided plural ranges. Also, it is preferable that the musical tone signal generation controlling portion includes a velocity data converting portion for converting the values of velocity data belonging to each range of the divided ranges to values representing tone volume levels of musical tone signals of play style dependence tone colors corresponding to the range so as to supply the converted values to the musical tone signal generating circuit whereby the tone volume levels of the musical tone signals of the play style dependence tone colors are controlled in accordance with the converted values representing the tone volume levels.

According to this, musical tone signals of plural kinds of play style dependence tone colors can be formed with the use of velocity data, and also the tone volume levels of the musical tone signals generated in accordance with the velocity data can be controlled, thereby leading to improvements in the quality of the generated musical tone signals.

Further, in the first characteristic feature of the present invention, it is preferable that each of the sets of musical tone generating parameters respectively corresponding to the plural kinds of play style dependence tone colors is further made of plural sets of sub musical tone generating parameters respectively assigned to different values of the note number data, and the musical tone signal generation controlling portion controls reading one set of sub musical tone generating parameters that belongs to the one set of musical tone generating parameters assigned to the value of the velocity data and is assigned to a value of the note number data from the parameter memory.

This allows that, in the case of generating musical tone signals having different tone pitch ranges or different tone pitches, the musical tone signals are generated with the use of different sub musical tone generating parameters even if the musical tone signals belong to one and the same play style dependence tone color, thereby leading to improvements in the quality of the generated musical tone signals.

The second characteristic feature of the present invention lies in that the note number data is used in place of the velocity data in the aforementioned first characteristic feature of the present invention, and some play style dependence tone colors among the plural kinds of play style dependence tone colors are assigned to values of note number data belonging to some range, while some other play style dependence tone colors among the plural kinds of play style dependence tone colors are assigned to values of note number data belonging to some other range, wherein the musical tone signal generation controlling portion controls reading one set of musical tone generating parameters corresponding to a play style dependence tone color that is assigned to a value of the note number data in the input first performance data from the parameter memory and supplying the read one set of musical tone generating parameters to the musical tone signal generating circuit, so as to allow the musical tone signal generating circuit to generate a musical tone signal of the play style dependence tone color corresponding to the read one set of musical tone generating parameters.

The second characteristic feature of the present invention also lies in that the parameter memory stores plural sets of musical tone generating parameters for respectively generating musical tone signals of plural kinds of play style dependence tone colors for each of plural kinds of musical instrument tone colors, and the musical tone signal generation controlling portion also inputs a second performance data for selecting any one kind of musical instrument tone color from among plural kinds of musical instrument tone colors respectively corresponding to plural kinds of musical instruments in addition to the first performance data, and controls reading one set of musical tone generating parameters corresponding to a play style dependence tone color that belongs to a musical instrument tone color designated by the input second performance data and is assigned to a value of the note number data in the input first performance data from the parameter memory and supplying the read one set of musical tone generating parameters to the musical tone signal generating circuit, so as to allow the musical tone signal generating circuit to generate a musical tone signal of the play style dependence tone color corresponding to the read one set of musical tone generating parameters.

According to these second characteristic features, musical tone signals of plural kinds of play style dependence tone colors being different from one another in terms of play styles in one and the same kind of musical instrument can be generated simply by setting the note number data in the first performance data to various values. This provides shorter processing time needed for switching among the play style dependence tone colors in this second characteristic feature as well. Also, this simplifies the work of editing the performance data including designation of a play style dependence tone color, and prevents occurrence of errors in the editing work.

Further, in the aforesaid second characteristic feature of the present invention, it is preferable that said some other play style dependence tone colors are tone colors of play styles that is not associated with specific tone pitches, and the values of note number data belonging to said some other range represent tone pitches outside of a tone pitch range that can be generated as musical tone signals having one specific tone pitch. According to this, the play style dependence tone colors that are not associated with specific tone pitches, such as strumming, fret noise, and glissando, are assigned to note number data representing tone pitches outside the tone pitch range that can be generated as musical tone signals having one specific tone pitch, for example, to note number data representing tone pitches within a tone pitch range that cannot be generated in the relevant musical instrument, so that the note number data can be effectively used without hindering the generation of musical tone signals having tone pitches.

Further, in the aforesaid second characteristic feature of the present invention, it is preferable that said other play style dependence tone colors are made of plural kinds of play style dependence tone colors, and some other range includes plural different values of note number data, and the plural kinds of play style dependence tone colors belonging to said other play style dependence tone colors are respectively assigned to different values among the plural values of note number data belonging to said some other range. According to this, plural kinds of other play style dependence tone colors can be used, whereby variegated musical tone signals can be generated.

Further, in the aforesaid second characteristic feature of the present invention, it is preferable that said first performance data includes a velocity data representing a tone volume level of the musical tone signal; at least one of said some play style dependence tone colors and said some other play style dependence tone colors are made of plural kinds of play style dependence tone colors; the plural kinds of play style dependence tone colors belonging to said at least one of said some play style dependence tone colors and said some other play style dependence tone colors are respectively assigned to different values of said velocity data; and said musical tone signal generation controlling portion controls reading a musical tone generating parameter assigned to a value of the note number data in said input first performance data and assigned to a value of the velocity data in the first performance data among the plural sets of musical tone generating parameters respectively corresponding to the plural kinds of play style dependence tone colors belonging to said at least one of said some play style dependence tone colors and said some other play style dependence tone colors from said parameter memory.

According to this, by using the velocity data in addition to the note number data, multiple kinds of play style dependence tone colors can be used, whereby more variegated musical tone signals can be generated.

Further, the third and fourth characteristic features of the present invention lie in that the musical tone signal generation controlling portion in the musical tone generating apparatus according to the aforesaid first and second characteristic features of the present invention is constituted with a computer, so as to realize various functions in the aforesaid first and second characteristic features of the present invention with a musical tone generating computer program applied to the computer included within the musical tone generating apparatus. Various effects described before can be expected according to these features as well.

DESCRIPTION OF THE PREFERRED EMBODIMENTS

Figure 1:
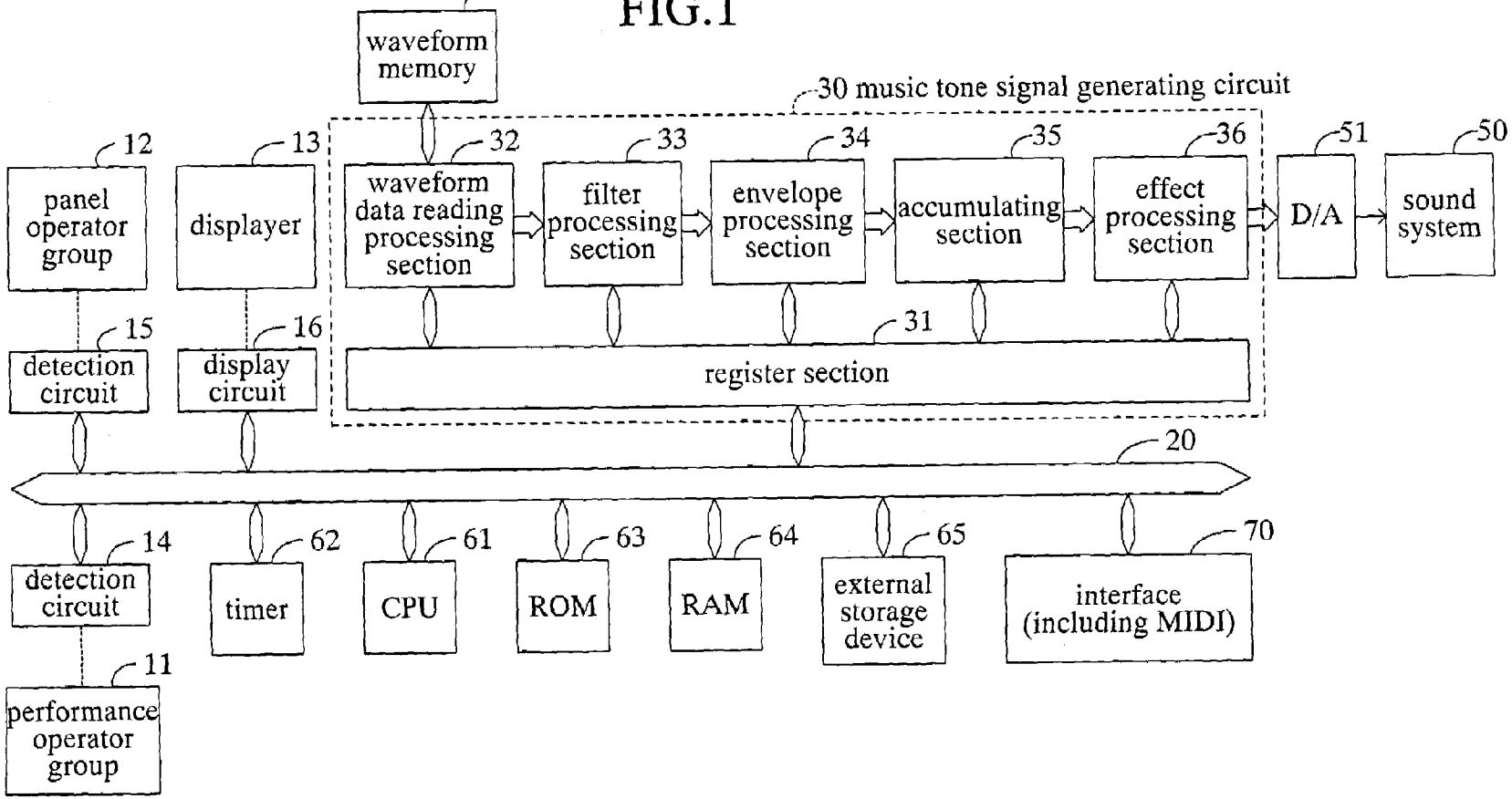
FIG. 1 is a schematic block diagram illustrating an electronic musical instrument to which the present invention is applied.

Hereafter, one embodiment of the present invention will be described with reference to the attached drawings. FIG. 1 is a schematic block diagram illustrating an electronic musical instrument to which the musical tone generating apparatus and the musical tone generating computer program according to the present invention are applied.

This electronic musical instrument includes a play operator group 11, a panel operator group 12, and a displayer 13. Play operator group 11 is constructed, for example, with a keyboard made of plural keys or the like, and an operation thereof gives instructions for generation of musical tones and on the tone pitch of the musical tones to be generated. Panel operators in panel operator group 12 are respectively disposed on an operation panel, and an operation thereof gives instructions on an operation of the electronic musical instrument as a whole including designation of tone colors, tone volume levels, and the like of the musical tones to be generated, indication of the display contents on displayer 13, and others. Here, this panel operator group 12 is meant to include operators such as ten-keys, cursor movement keys, and a mouse. The operations of these play operator group 11 and panel operator group 12 are respectively detected by detection circuits 14, 15 connected to a bus 20. Displayer 13 is constructed with a CRT displayer, a liquid crystal displayer, or the like, and displays various information with the use of characters, numerals, or figures. Display of this displayer 13 is controlled by a display circuit 16 connected to bus 20.

Further, this electronic musical instrument also includes a musical tone signal generating circuit 30 connected to bus 20 for generating musical tone signals. Musical tone signal generating circuit 30 includes a register section 31, a waveform data reading processing section 32, a filter processing section 33, an envelope processing section 34, an accumulating section 35, and an effect processing section 36.

Register section 31 is made of plural sets of registers respectively corresponding to plural tone generation channels connected to bus 20,and store temporarily various data supplied via bus 20 for controlling each section 32 to 36 of musical tone signal generating circuit 30. Waveform data reading processing section 32 selectively reads waveform data stored in waveform memory 40. Waveform memory 40 stores plural sets of waveform data respectively obtained by sampling the musical tone waveforms of plural kinds of musical instruments in correspondence with musical instrument tone colors. Generally, in these musical tone waveform data, for one kind of musical instrument tone color, a different set of waveform data is prepared for each predetermined tone pitch range (or for each tone pitch). Further, for a velocity data value (tone volume level), plural sets of waveform data may be prepared in correspondence with its level. Here, this waveform data constitutes part of the musical tone generating parameters.

Further, waveform memory 40 may be constituted with a ROM or a RAM, or ROM and RAM may be used in combination. If waveform memory 40 is constituted with RAM, the waveform data may be stored in another recording medium (for example, a later-mentioned hard disk), and the waveform data may be read out from the recording medium to be written into RAM at the time when the power switch is turned on or the like. Further, use of RAM facilitates use of a waveform data that is newly prepared. Further, if a non-volatile and writable memory such as EEPROM is used, one can avoid writing of the waveform data at the time when the power is turned on.

Particularly, in the present embodiment, with regard to a musical instrument that is played by different play styles, for one kind of musical instrument tone color, waveform data corresponding to plural play style dependence tone colors being different from one another in terms of play styles are stored by being assigned to each value of the velocity data and the note number data. This point will be described by raising the musical instrument tone colors of a steel guitar and an electric bass guitar as examples. Here, the velocity data represents the tone volume level of a musical tone signal that usually increases according as the value thereof increases. In the present embodiment, the velocity data changes in the range from "0" to "127". The note number data represents the tone pitch (note name) of a musical tone signal that usually changes towards the high tone side according as the value thereof increases. In the present embodiment, the note number data changes in the range from "0" to "127". Here, the value "0" of the note number data corresponds to the note name C2, and the value "127" corresponds to the note name G8.

Referring to FIG. 5A, in the case of steel guitar tone colors, eight kinds of play style dependence tone colors made of open soft play style tone color, open middle play style tone color, open hard play style tone color, dead note play style tone color, mute play style tone color, hammering play style tone color, slide play style tone color, and harmonics play style tone color are assigned to the tone pitch range C2 to B5 (corresponding to "0" to "95" of note numbers) that is available for playing a general steel guitar. Further, these play style dependence tone colors are respectively assigned to different ranges of velocity data values. Specifically, for example, the open soft play style tone color is assigned to the range of velocity data values "0" to "15"; the open middle play style tone color to the range of values "16" to "30"; the open hard play style tone color to the range of values "31" to "45"; the dead note play style tone color to the range of values "46" to "60"; the mute play style tone color to the range of values "61"to "75"; the hammering play style tone color to the range of values "76" to "90"; the slide play style tone color to the range of values "91" to "105"; and the harmonics play style tone color to the range of values "106" to "127", as shown in FIG. 5B.

Further, referring to FIG. 5A again, play style tone colors that are not associated with specific tone pitches are assigned to the range of the tone pitch range C6 to G8 (corresponding to "96" to "127" of note number) that is not used in a general steel guitar play, i.e. that is generally incapable of generating musical tones. Strumming play style tone color is assigned to the tone pitch range C6 to D7 (corresponding to "96" to "110" of note numbers). This strumming play style tone color further includes plural different strumming play style tone colors that are dependent on the difference in the speed of stroke, the position of muting with a left hand, and the like. These plural different strumming play style tone colors are respectively assigned to different tone pitches within the tone pitch range C6 to D7. Further, fret noise play style tone color is assigned to the tone pitch range D#7 to G8 (corresponding to "111" to "127" of note numbers). This fret noise play style tone color further includes plural different fret noise play style tone colors such as a scratch sound that is obtained by scratching a string with a finger or a pick and a sound that is generated by slapping the main body of the steel guitar. These plural different fret noise play style tone colors are respectively assigned to different tone pitches within the tone pitch range D#7 to G8.

Referring to FIG. 6A, in the case of electric bass guitar tone colors, four kinds of play style dependence tone colors made of finger open play style tone color, mute play style tone color, dead note play style tone color, and slap play style tone color are assigned to the tone pitch range C2 to B5 (corresponding to "0" to "95" of note numbers) that is available for playing a general electric bass guitar. Further, these play style dependence tone colors are respectively assigned to different ranges of velocity data values. Specifically, for example, the finger open play style tone color is assigned to the range of velocity data values "0" to "40"; the mute play style tone color to the range of values "41" to "80"; the dead note play style tone color to the range of values "81" to "120"; and the slap play style tone color to the range of values "121" to "127", as shown in FIG. 6B.

Further, referring to FIG. 6A again, play style tone colors that are not associated with specific tone pitches are assigned to the range of the tone pitch range C6 to G8 (corresponding to "96" to "127" of note numbers) that is not used in a general electric bass guitar play, i.e. that is generally incapable of generating musical tones. Glissando play style tone color is assigned to the tone pitch range C6 to D7 (corresponding to "96" to "110" of note numbers). This glissando play style tone color further includes plural different glissando play style tone colors that are dependent on the difference in the speed of tone pitch change, the direction of tone pitch change, and the like. These plural different glissando play style tone colors are respectively assigned to different tone pitches within the tone pitch range C6 to D7. Further, fret noise play style tone color is assigned to the tone pitch range D#7 to G8 (corresponding to "111" to "127" of note numbers) in the same manner as in the case of the aforementioned steel guitar.

For each of these eight kinds of play style dependence tone colors assigned to the tone pitch range C2 to B5 of steel guitar and these four kinds of play style dependence tone colors assigned to the tone pitch range C2 to B5 of electric bass guitar, one set of waveform data may be prepared; however, in the present embodiment, waveform data made of plural sets of sub waveform data are prepared. Each of these plural sets of sub waveform data is provided for each predetermined tone pitch range (for example, half octave). These sub waveform data are stored in waveform memory 40. Here, in the present embodiment, these sub waveform data are provided commonly for different values of the velocity data; however, the sub waveform data may be made different in accordance with the values of the velocity data.

Further, with regard to the strumming play style tone color, fret noise play style tone color, and glissando play style tone color assigned to the tone pitch range C6 to G8 of steel guitar and electric bass guitar, for each of the aforesaid plural kinds of strumming play style tone colors, fret noise play style tone colors, and glissando play style tone colors, one set of waveform data is prepared. In this case also, each waveform data is stored in waveform memory 40. Here, in the present embodiment, the waveform data respectively corresponding to the aforesaid plural kinds of strumming play style tone colors, fret noise play style tone colors, and glissando play style tone colors are provided commonly for different values of the velocity data; however, the waveform data may be made different in accordance with the values of the velocity data.

Filter processing section 33 is constituted with a digital filter, and performs a filtering process on the waveform data read out in waveform data reading processing section 32 to impart desired frequency characteristics to the musical tone signals to be generated. Envelope processing section 34 is constituted with a waveform forming section for forming an amplitude envelope waveform and a multiplier, and imparts a desired amplitude envelope to the waveform data (waveform signals) from filter processing section 33 for output as digital musical tone signals. Here, these waveform data reading processing section 32, filter processing section 33, and envelope processing section 34 respectively execute each process in synchronization with plural time division channel timings. These plural time division channel timings respectively correspond to plural tone generation channels, and the plural tone generation channels respectively correspond to play parts of the music.

Accumulating section 35 accumulates digital musical tone signals supplied from envelope processing section 34 in synchronization with the aforesaid plural time division channel timings to output a digital musical tone signal obtained as a sum of the plural digital musical tone signals. Effect processing section 36 imparts musical effects such as chorus and reverb to the digital musical tone signal from accumulating section 35.

The digital musical tone signal generated in this manner is output from musical tone signal generating circuit 30 to be supplied to a sound system 50 via a D/A converter 51. D/A converter 51 converts the aforesaid output digital musical tone signal into an analog musical tone signal. Sound system 50 is composed of amplifiers and speakers, and generates musical tones corresponding to the analog musical tone signal.

Further, a CPU 61, a timer 62, a ROM 63, a RAM 64, and an external storage device 65 are connected to bus 20. CPU 61, timer 62, ROM 63, and RAM 64 constitute a main body of a microcomputer, and executes various programs to control various operations of the electronic musical instrument.

External storage device 65 is made of a recording medium such as a hard disk HD incorporated in advance, or a flexible disk FD or compact disk CD attachably and detachably mounted as well as a drive unit capable of reading and writing programs and data from and to the recording medium. The external recording medium stores various programs and various data. Particularly in the present embodiment, the external recording medium stores tone color data constituting a part of the musical tone generating parameters (See FIG. 2), various automatic performance data (See FIG. 7), automatic play programs, tone color selection event programs (See FIG. 3), and tone generating instruction event programs (See FIG. 4). Further, a part of the various programs and various data are stored also in ROM 63.

Figure 2:
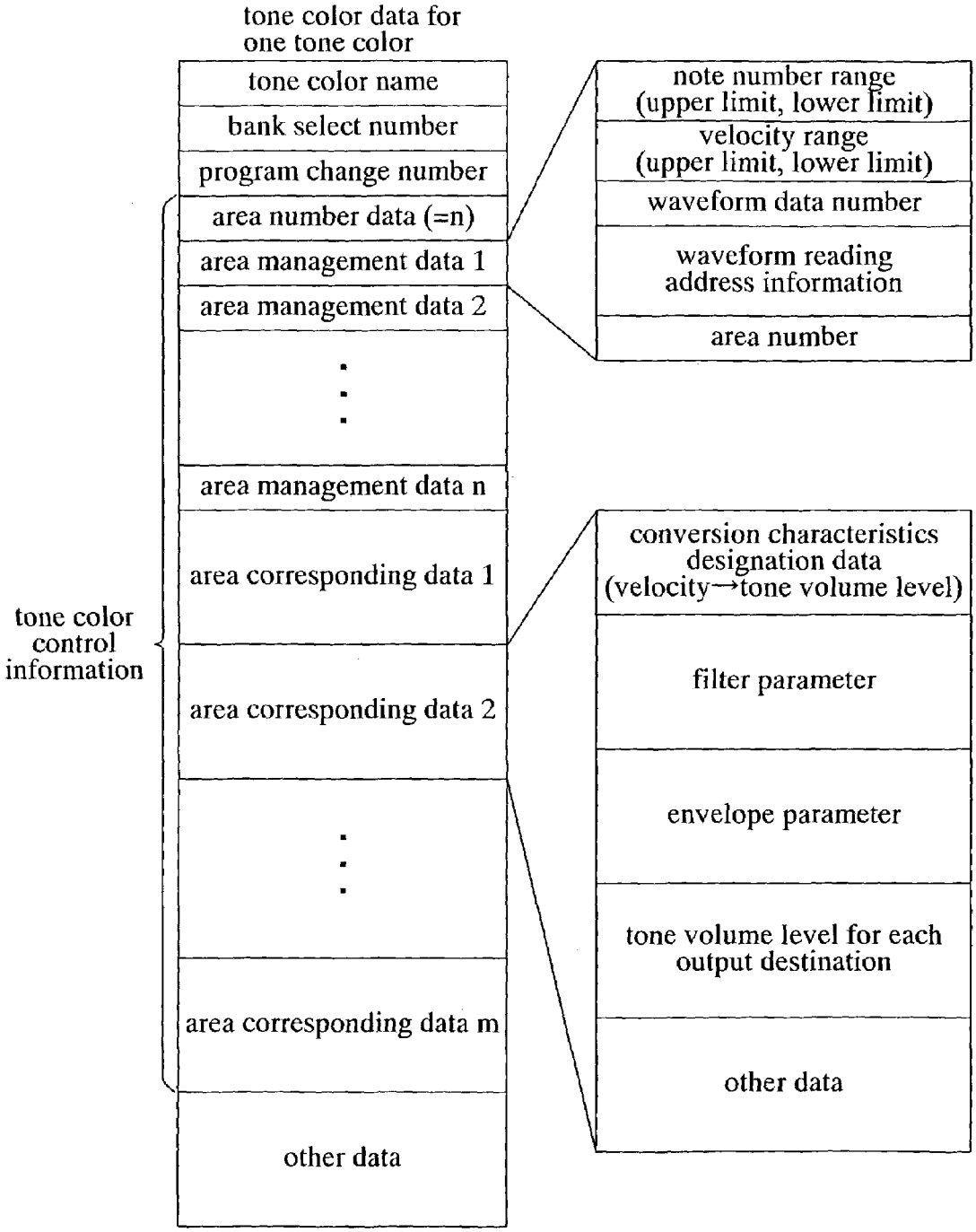
FIG. 2 is a format diagram showing a format of tone color data stored in an external storage device, ROM, or the like of FIG. 1.

The contents of these programs will be described together with a description of the operations of the electronic musical instrument. Here, the aforesaid tone color data will be described. FIG. 2 shows tone color data concerning one kind of musical instrument tone color such as, for example, a piano, a steel guitar, or an electric bass guitar. The tone color data of each musical instrument tone color is made of a tone color name data representing the tone color name, a bank select number data and program change number data for designating a musical instrument tone color, tone color control information, and other data.

The tone color control information is made of information that belongs to one kind of musical instrument tone color and is used for generation of musical tone signals of areas divided by the values of note number data and velocity data in collaboration with the aforesaid waveform data stored in waveform memory 40. The tone color control information is made of an area number data representing the number of the aforesaid divided areas, plural area management data for managing the respective areas, and area-corresponding data designated by each area management data. Here, although the number of the sets of the area management data is the number indicated by the area number data ("n" in the example of FIG. 2), the number of the sets of the area-corresponding data ("m" in the example of FIG. 2) may be equal to or smaller than the number of the area management data. Further, the number of the sets of the aforesaid waveform data belonging to one kind of musical instrument may be equal to or smaller than the number of the area management data, and may be different from the number of the sets of the area-corresponding data.

Each area management data is made of note number range data, velocity range data, waveform data number, waveform reading address information, and area number data related to each of the aforesaid divided areas. The note number range data are made of data respectively indicating the upper limit value and the lower limit value of the values of the note number data belonging to the area. The velocity range data are made of data respectively indicating the upper limit value and the lower limit value of the values of the velocity data belonging to the area. The waveform data number indicates the number of waveform data stored in waveform memory 40 and used for the generation of musical tone signals. The waveform reading address information is made of a start address, an end address, addresses indicating the loop (repetition) part, and others of the aforesaid waveform data in waveform memory 40. The area number data is data for designating one set of area-corresponding data.

The area-corresponding data are each made of conversion characteristics designating data, filter parameters, envelope parameters, tone volume level for each output destination, and other data. The conversion characteristics designating data are conversion data for converting, in the case of a musical tone signal of a play style dependence tone color, the velocity data value into data value representing the tone volume level of the musical tone signal. This point will be described with reference to FIGS. 5B and 6B. In the case of musical instrument tone colors having play style dependence tone colors such as steel guitar tone colors and electric bass guitar tone colors, since the velocity data values "0" to "127" are assigned to plural kinds (eight kinds in the case of steel guitar tone colors; four kinds in the case of electric bass guitar tone colors) of play style dependence tone colors in the tone pitch range C2 to B5, the velocity data values cannot be used as they are for control of the tone volume level. On the other hand, velocity data of a predetermined range including plural different velocity data values are assigned to eight kinds of play style dependence tone colors. Therefore, when the velocity data values of a predetermined range assigned to each play style dependence tone color are converted as shown by solid lines in FIGS. 5B and 6B, the tone volume level for the musical tone signal of each play style dependence tone color can be controlled. Here, the broken lines in FIGS. 5B and 6B show original tone volume level control characteristics using the velocity data values that change from "0" to "127".

This point will be specifically described. For example, in the case of a dead note play style tone color of a steel guitar tone color in FIG. 5B, the velocity data values within the range from "46" to "60" are assigned to the tone color. Therefore, when these velocity data values within the range from "46" to "60" are converted into velocity data values that change from a predetermined small value (for example, about "30") to a predetermined large value (for example, about "127"), the tone volume level of the musical tone signal of the dead note play style dependence tone color can be changed from the predetermined small value to the predetermined large value, though the resolution is low. Further, in the case of a mute play style tone color of a steel guitar tone color, the velocity data values ranging from "61" to "75" may be converted into velocity data values that change from a predetermined small value (for example, about "30") to a predetermined large value (for example, about "127").

Similarly, in the case of hammering play style tone color, slide play style tone color, and harmonics play style tone color of the steel guitar tone color, by conversion of the velocity data values, the tone volume level of the musical tone signal of each play style dependence tone color can be controlled with the converted velocity data value. Further, referring to FIG. 6B again, regarding the four kinds of play style dependence tone colors of finger open play style tone color, mute play style tone color, dead note play style tone color, and slap play style tone color assigned to the velocity data values of the electric bass guitar tone color, by conversion of the velocity data values, the tone volume level of the musical tone signal of each play style dependence tone color can be controlled with the converted velocity data value.

In addition, the three kinds of play style dependence tone colors made of open soft play style tone color, open middle play style tone color, and open hard play style tone color of the steel guitar tone color are classified by the strength with which the steel guitar is played, so that the three kinds of play style dependence tone colors are dependent on the difference of tone volume level rather than on the tone color. Moreover, these three kinds of play style dependence tone colors are extremely similar to one another. Therefore, it is sufficient that the velocity data values within the range from "0" to "45" assigned to these three kinds of play style dependence tone colors are converted into velocity data values that change from a small predetermined value (for example, about "30") to a large predetermined value (for example, about "127"). Here, in FIGS. 5B and 6B, the range of values that the converted velocity data values can assume are the same for all kinds of the play style dependence tone colors; however, the range may be changed for each play style dependence tone color.

Further, the conversion characteristics designation data are constituted with data that indicate conversion characteristics for converting the velocity data values in the musical tone signals of play style dependence tone color such as described above. The filter parameter controls the filter characteristics in filter processing section 33. The envelope parameter controls the amplitude envelope characteristics in envelope processing section 34. The tone volume level for each output destination controls the output amount to circuits that are subsequent to accumulating section 35 such as effect processing section 36 in accordance with the kind of the musical tone signal, for each digital musical tone signal before accumulation. In this case, accumulating section 35 must accumulate the digital musical tone signals for each output destination of the digital musical tone signals instead of accumulating the digital musical tone signals in synchronization with all the time division channel timings.

Next, the automatic performance data will be described. This automatic performance data is prepared for each piece of music, and an example thereof is partially shown in FIG. 7. Each automatic performance data is arranged in time sequence in accordance with the progression of music, and includes various performance event data such as tone color event data, note-on event data, note-off event data, as well as duration data representing the time interval between the performance event data.

The tone color event data is a data used for designating a tone color of the musical tone signal at the time of starting to play the piece of music, or for changing the tone color of the musical tone signal during the playing of the piece of music. This tone color event data is made of two kinds of data, i.e. bank switching tone color event data made of bank select code, part number data, and bank select number data, and program switching tone color event data made of program change code, part number data, and program change number data. The bank switching tone color event data belongs to a stratum above the program switching tone color event data. After one tone color group is designated by the bank switching tone color event data, one tone color is designated among the aforesaid designated one tone color group by the program switching tone color event data. Therefore, if the tone colors belonging to one and the same tone color group (one and the same bank) are successively changed, it is sufficient to change only the program switching tone color event data.

The bank select code is an identification code indicating the bank switching tone color event data, and the program change code is an identification code indicating the program switching tone color event data. Further, the part number data represents a play part of the music whose tone color is to be designated or changed (corresponding to a tone generation channel of musical tone signal generating circuit 30). The bank select number data represents one of the aforesaid tone color groups, and the program change number data represents one tone color belonging to the aforesaid tone color group. However, the tone colors as referred to herein represent musical instrument tone colors corresponding to the kind of musical instrument such as, for example, a piano, a steel guitar, or an electric bass guitar.

Each note-on event data is for indicating the start of generating musical tone signals, and includes a part number data, a note number data, and a velocity data in addition to a note-on code as an identification code representing the start of generating the musical tone signals. The part number data corresponds to a channel number at which the musical tone signals are to be generated among the plural tone generation channels of musical tone signal generating circuit 30. The note number data and the velocity data generally represent the tone pitch and the tone volume level, respectively, of the musical tone signal. However, in the case where one kind of musical instrument tone color has plural play style dependence tone colors, such as the above described case, these note number data and velocity data are used also for the designation of a play style dependence tone color. The note-off event data is for ending the musical tone signal that has been generated by the aforesaid note-on event data.

Further, an interface circuit 70 including a MIDI interface circuit and a communication interface circuit is connected to bus 20. The MIDI interface circuit is connected to performance device apparatus such as a keyboard, other musical instruments, personal computers, and other MIDI-conforming apparatus such as an automatic play apparatus (sequencers), and receives MIDI information from the apparatus. The communication interface circuit is connected to a server computer via a communication network (for example, the internet) so as to send and receive data and programs to and from the server computer.

Next, an operation of the embodiment constructed as shown above will be described. First, a user starts execution of an automatic play program stored in a hard disk of external storage device 65 (not illustrated). By the start of execution of this automatic play program, the tone color selection event program of FIG. 3 and the tone generating instruction event program of FIG. 4 stored in the hard disk of external storage device 65 are also started. Here, in the event that these automatic play program, tone color selection event program, and tone generating instruction event program are not stored in the hard disk of external storage device 65, execution of the aforesaid programs may be started after the programs are installed from a compact disk, a flexible disk, or the like into the hard disk, or after the programs are downloaded into the hard disk from an external apparatus such as a MIDI-conforming apparatus, a server connected to a communication network, or the like via interface circuit 70.

Also, the user designates a piece of music that the user wishes to reproduce by execution of this automatic play program or by operating panel operator group 12 while looking at a display screen of displayer 13 independently from the execution of the automatic play program. The user then allows RAM 64 to store automatic performance data related to the designated piece of music. In this case, as the automatic performance data, those stored in the hard disk, compact disk, flexible disk, or the like of external storage device 65 can be used, or alternatively the automatic performance data can be supplied from an external apparatus such as a MIDI-conforming apparatus or a server connected to a communication network via interface circuit 70.

Figure 7:
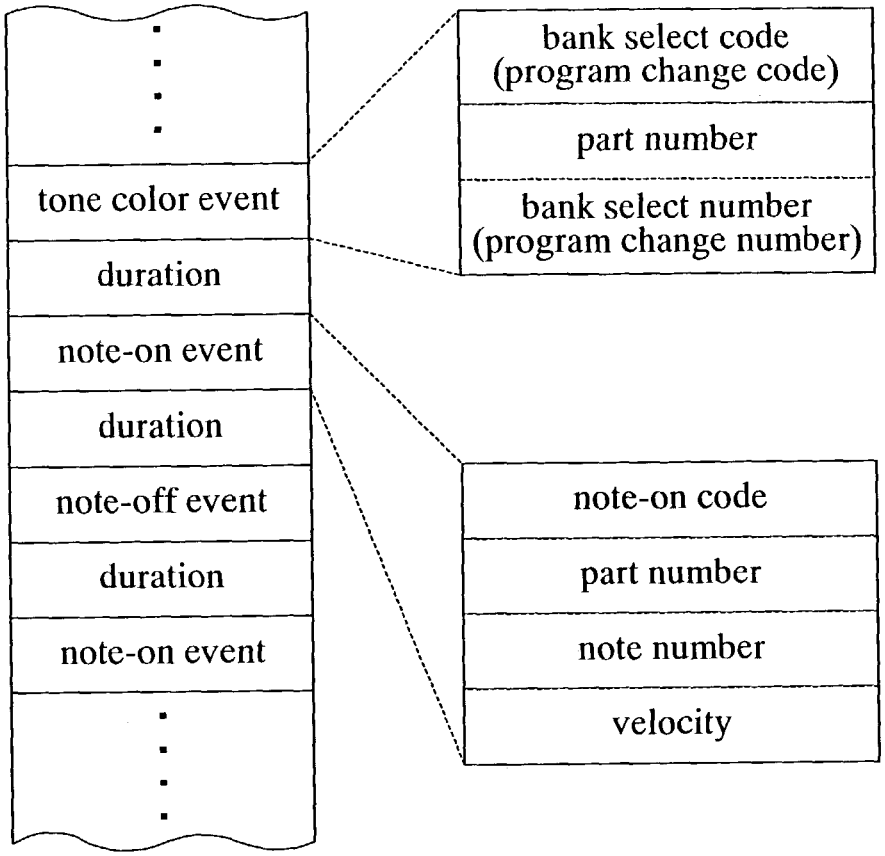
FIG. 7 is a format diagram showing one example of automatic performance data.

Next, when the user gives instructions for the start of playing, CPU 61 by execution of the aforesaid automatic play program starts reproduction of the aforesaid automatic performance data taken in into RAM 64. In the reproduction of this automatic performance data, performance data such as shown in FIG. 7 and stored in RAM 64 are successively read out in accordance with the progression of a piece of music.

Figure 3:
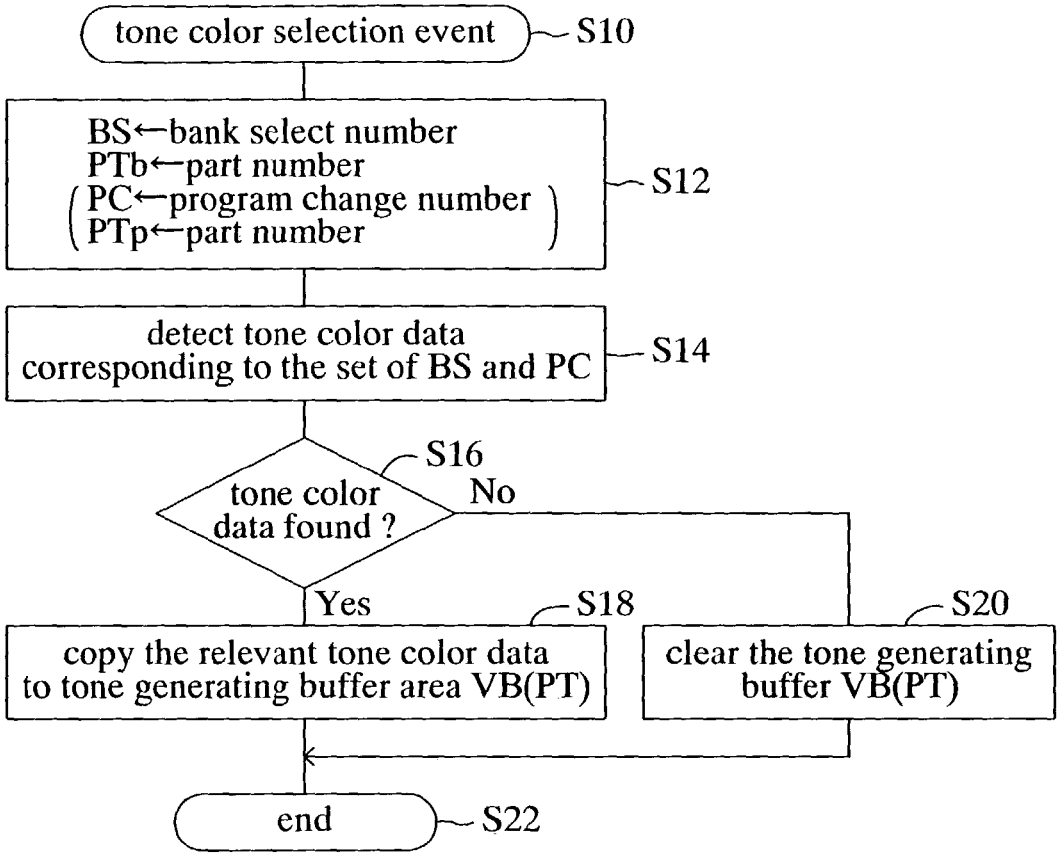
FIG. 3 is a flowchart of tone color selection event program stored in an external storage device or the like of FIG. 1 and executed by the CPU.

In reading this performance data out, when the tone color event data is read out, CPU 61 starts execution of the tone color selection event program of FIG. 3 at step S10. After the start of the execution of this tone color selection event program, at step S12, CPU 61 sets the bank select number data, the program channel number data, and the part number data included in the read tone color event data as a bank select number BS, a program channel number PC, and part numbers PTb, PTp which are variables. Specifically, if the read tone color event data is a bank switching tone color event data, bank select number BS and part number PTb are set to be the read bank select number data and part number data, respectively. If the read tone color event data is a program switching tone color event data, program change number BS and part number PTp are set to be the read program change number data and part number data, respectively. Then, the set of bank select number BS and part number PTb and the set of program change number BS and part number PTp that have been set are preserved until new bank switching tone color event data and program switching tone color event data are read out.

Next, at step S14, CPU 61 checks whether a tone color data (See FIG. 2) defined by bank select number BS and program channel number PC having the same part numbers PTb, PTp is present or not in external storage device 65 or ROM 63.

If a tone color data corresponding to the aforesaid two numbers PC, BS is present, CPU 61 determines as "Yes" at step S16 and proceeds to step S18. At step S18, CPU 61 reads the aforesaid tone color data from external storage device 65 or ROM 63, and stores the tone color data in a tone generating buffer area VB(PT) prepared in advance in RAM 64 and designated by the part number PT. Here, this tone color data is a tone color data for the aforesaid one tone color of FIG. 2. On the other hand, if a tone color data corresponding to the aforesaid two numbers PC, BS is not present, CPU 61 determines as "No" at step S16 and proceeds to step S20. At step S20, CPU 61 clears the tone color data in the aforesaid tone generating buffer area VB(PT) prepared in RAM 64. Then, after the aforesaid processes of steps S18, S20, CPU 61 ends the execution of the tone color selection event program at step S22.

Figure 4:
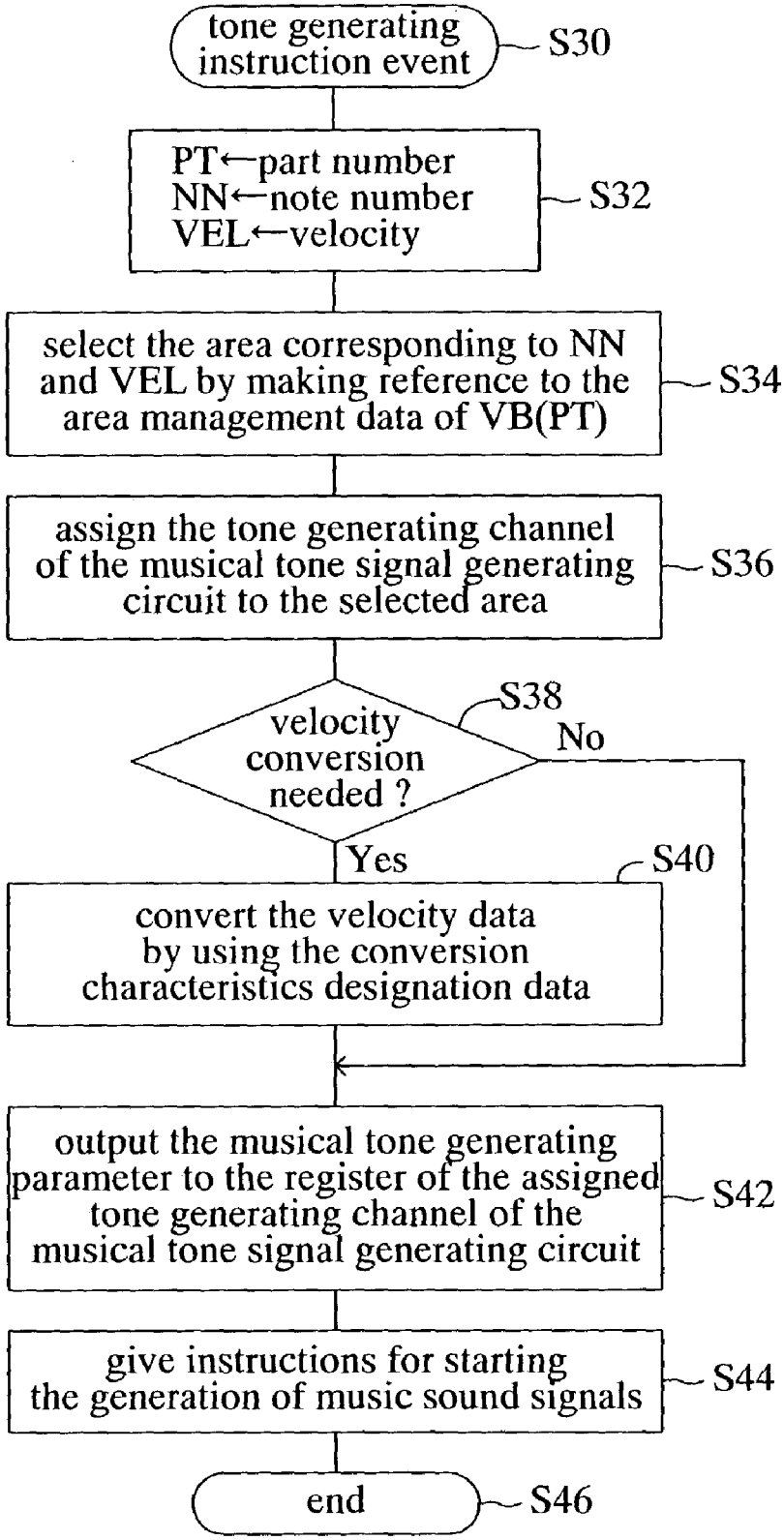
FIG. 4 is a flowchart of tone generating instruction event program stored in an external storage device or the like of FIG. 1 and executed by the CPU.

Meanwhile, if the note-on event data is read out, CPU 61 starts execution of the tone generating instruction event program of FIG. 4 at step S30. After the start of execution of this tone generating instruction event program, at step S32, CPU 61 sets the part number data, the note number data, and the velocity data included in the read note-on event data as a part number PT, a note number NN, and a velocity VEL which are variables. Next, at step S34, CPU 61 selects an area corresponding to the note number NN and the velocity VEL by making references to the area management data 1 to n in the tone color data stored in the tone generating buffer area VB(PT) of RAM 64.

Specifically, CPU 61 checks whether the note number NN is within the range represented by the note number range data in each area management data and whether the velocity VEL is within the range represented by the velocity range data in each area management data. If both the note number NN and the velocity VEL are respectively within the aforesaid ranges, CPU 61 determines that it is the relevant area, whereby the waveform data number, the waveform reading address information, and the area number data in this area management data are read out from the tone generating buffer area VB(PT) and temporarily stored into a different area in RAM 64. In addition, the area number data is used also for selection of an area-corresponding data, and the area-corresponding data designated by the area number data also is read out from the tone generating buffer area VB(PT) and temporarily stored into a different area in RAM 64. Here, by this process, plural relevant areas may be selected in some cases.

Next, at step S36, CPU 61 assigns tone generation channels of musical tone signal generating circuit 30 one by one to the aforesaid selected areas. If plural areas have been selected as described above, plural tone generation channels are assigned.

After the aforesaid process of step S36, at step S38, CPU 61 determines the need for conversion of the velocity data value by checking whether a conversion characteristics designating data, i.e. a conversion data for converting the velocity data value, is present or not in the aforesaid selected area-corresponding data. If there is no need for converting the velocity data value, CPU 61 determines as "No" at step S38 and proceeds to step S42. On the other hand, if there is a need for converting the velocity data value, CPU 61 determines as "Yes" at step S38 and proceeds to step S40. At step 40, CPU 61 changes the aforesaid velocity VEL that has been temporarily stored in RAM 64 to a new velocity VEL representing a real tone volume level by using the conversion characteristics designating data. Specifically, if the play style dependence tone colors are respectively assigned to different velocity data values, the velocity data values of "0" to "127" are changed to values shown by solid lines in FIGS. 5B and 6B.

After the aforesaid process of step S40 or after it is determined as "No" in step S38, at step S42, CPU 61 supplies the aforesaid musical tone generating parameters made of the waveform data number, waveform reading address information and the area-corresponding data temporarily stored in RAM 64 to a register corresponding to the assigned tone generation channel of register section 31 in musical tone signal generating circuit 30 in addition to the note number NN and velocity VEL (the velocity after conversion if it is converted using the conversion characteristics designating data). The aforesaid area-corresponding data include the filter parameter, envelope parameter, tone volume level data for each output destination, and other data. Then, CPU 61 gives instructions to musical tone signal generating circuit 30 for starting the generation of musical tone signals at step S44, and ends the execution of the tone generating instruction event program at step S46.

Musical tone signal generating circuit 30 generates musical tone signals in accordance with the aforesaid supplied musical tone generating parameters in the aforesaid assigned tone generation channel by operations of waveform data reading processing section 32, filter processing section 33, and envelope processing section 34. Waveform data reading processing section 32 reads the waveform data designated by the aforesaid waveform data number from waveform memory 40 at a reading rate corresponding to the aforesaid note number NN by using the aforesaid waveform reading address information, and supplies the read waveform data to filter processing section 33 as a waveform signal. Here, the waveform data number, the note number NN and the waveform reading address information are supplied to register section 31. Filter processing section 33 performs a filtering process on the aforesaid supplied waveform signal by using the aforesaid filter parameter supplied to register section 31. Envelope processing section 34 imparts an amplitude envelope designated by the aforesaid envelope parameter supplied to register section 31 to the waveform signal that has been subjected to the filtering process, and controls the amplitude of the waveform signal in accordance with the aforesaid velocity VEL supplied to register section 31 to supply the waveform signal to accumulating section 35 as a digital musical tone signal.

Accumulating section 35 accumulates plural digital musical tone signals generated as described above. Effect processing section 36 then imparts musical effects to the aforesaid accumulated digital musical tone signals. In this case, accumulating section 35 and effect processing section 36 perform an accumulation process and an effect imparting process in accordance with the aforesaid tone volume level data for each output destination and other data supplied to register section 31. The musical tone signals to which the musical effects have been imparted in this manner are supplied to sound system 50 via D/A converter 51 and are generated in sound system 50 as musical tones.

On the other hand, the generation of the musical tones in the above-described manner is ended by reading the note-off event data in the performance data. In other words, when the note-off event data is read out in accordance with the progression of the music, CPU 61 gives instructions to musical tone signal generating circuit 30 for ending the generation of the musical tone signals designated by the note-off event data. Here, in order to designate the musical tone signals currently being generated, the note-off event data also includes a part number data and a note number data. By this process, musical tone signal generating circuit 30 ends the generation of the musical tone signals currently being generated when the note-off event data is read out. Then, the generation of the musical tones corresponding to the musical tone signals is also ended.

Next, such control of the generation of musical tone signals will be described by raising specific examples. Description will be made on the case where a musical instrument tone color having play style dependence tone colors, for example, a musical instrument tone color of a steel guitar or an electric bass guitar, has been selected. Here, this musical instrument tone color is designated by the program change number data and the bank select number data in the tone color event data. Then, if the note number data value in the note-on event data is within the range of "0" to "95" (corresponding to the tone pitch range C2 to B5), an area corresponding to at least one play style dependence tone color that accords to the velocity data value is selected from among plural play style dependence tone colors such as open soft and open middle by the area selecting process of step S34 of FIG. 4 (See FIGS. 5 and 6). Then, musical tone signal generating circuit 30 uses waveform data stored in waveform memory 40 and corresponding to the aforesaid selected play style dependence tone color, and generates musical tone signals in accordance with the area-corresponding data corresponding to the aforesaid selected area.

This allows that, simply by setting the velocity data in the note-on event data to have various values, one can generate musical tone signals of plural kinds of play style dependence tone colors being different from one another in terms of play styles in one and the same kind of musical instrument. This eliminates the need for using the bank select number data and the program change number data, thereby providing shorter processing time needed for switching among the play style dependence tone colors. Also, this simplifies the work of editing the performance data including designation of a play style dependence tone color, and prevents occurrence of errors in the editing work.

Further, in this generation of the musical tone signal of the play style dependence tone color, the velocity data value used for assigning the play style dependence tone color is converted into data representing the original tone volume level using the conversion characteristics designation data in the area-corresponding data by the process of step S40 of FIG. 4. Then, musical tone signal generating circuit 30 controls the tone volume level of the musical tone signal of the play style dependence tone color in accordance with this converted velocity data value (velocity VEL). According to this, musical tone signals of plural kinds of play style dependence tone colors can be formed with the use of velocity data, and also the tone volume levels of the musical tone signals data can be controlled in accordance with the velocity, thereby leading to improvements in the quality of the generated musical tone signals.

Further, in the above-described embodiment, the waveform data and area-corresponding data of the aforesaid same play style dependence tone color are each prepared in plural sets, and different waveform data and area-corresponding data belonging to one kind of play style dependence tone color are assigned to note number data values of different tone pitch ranges. Therefore, in the case of generating musical tone signals having different tone pitch ranges or different tone pitches, the musical tone signals are generated with the use of different waveform data and area-corresponding data even if the musical tone signals belong to one and the same play style dependence tone color, thereby leading to improvements in the quality of the generated musical tone signals.

Figure 5:
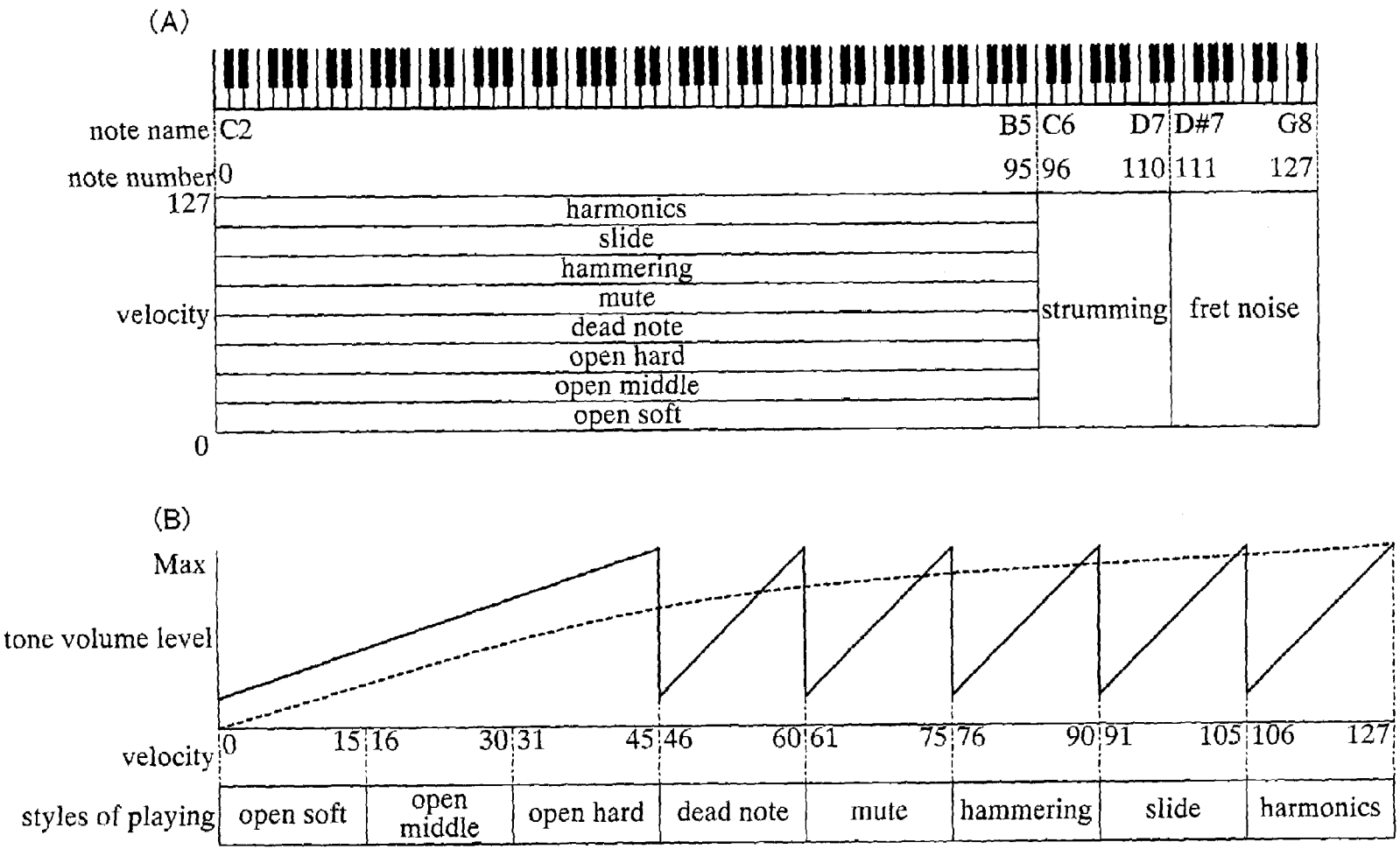
FIG. 5A is a view showing how play style dependence tone colors belonging to steel guitar tone colors are assigned to note names (note numbers)
FIG. 5B is a view showing how the play style dependence tone colors belonging to the steel guitar tone colors are assigned to velocities.
Figure 6:
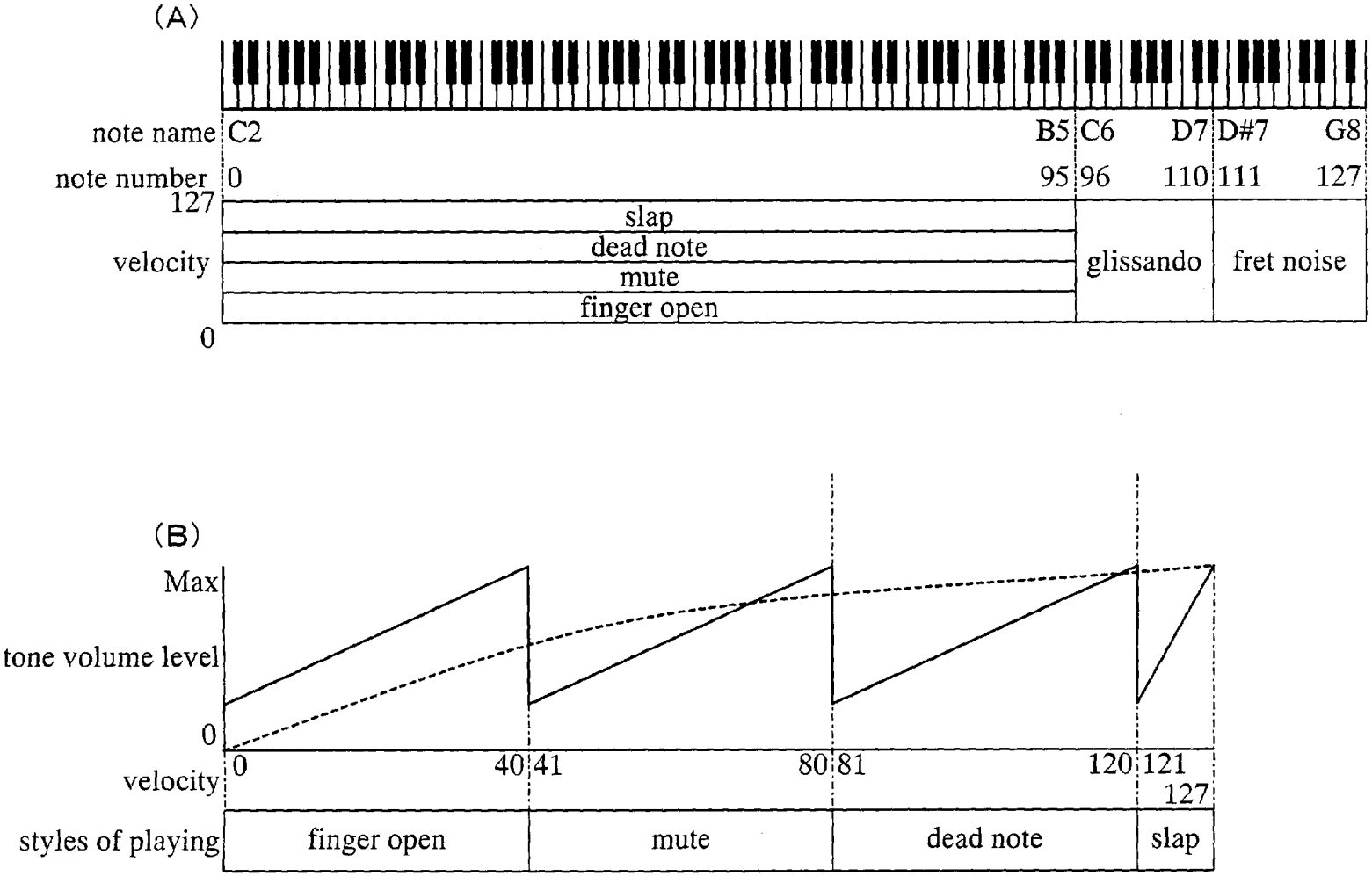
FIG. 6A is a view showing how play style dependence tone colors belonging to electric bass guitar tone colors are assigned to note names (note numbers)
FIG. 6B is a view showing how the play style dependence tone colors belonging to the electric bass guitar tone colors are assigned to velocities.

Further, if the note number data value in the note-on event data is within the range from "96" to "127" (corresponding to the tone pitch range C6 to G8) in a state in which a musical instrument tone color having play style dependence tone colors such as the aforesaid steel guitar tone color or electric bass guitar tone color is selected, an area corresponding to at least one play style dependence tone color is selected according to the note number data value from among the plural play style dependence tone colors such as strumming and fret noise by the area selection process of step S34 of FIG. 4 (See FIGS. 5 and 6). In this case also, musical tone signal generating circuit 30 generates musical tone signals in accordance with the area-corresponding data corresponding to the aforesaid selected area in the same manner as in the above-described case.

Considering that musical tone signals of play style dependence tone colors such as open soft and open middle are generated when the note number data value of the above-described case is within the range from "0" to "95" (corresponding to the tone pitch range C2 to B5), this means that different play style dependence tone colors are assigned to different note number data values ranging from "0" to "127" (corresponding to the tone pitch range C2 to G8) of the note number data value. Therefore, according to the above-described embodiment, musical tone signals of plural kinds of play style dependence tone colors being different from one another in terms of play styles in one and the same kind of musical instrument can be generated simply by setting the note number data in the note-on event data to various values. This provides shorter processing time needed for switching among the play style dependence tone colors in this case as well. Also, this simplifies the work of editing the performance data including designation of a play style dependence tone color, and prevents occurrence of errors in the editing work.

Further, the play style dependence tone colors, such as strumming and fret noise, assigned to within the aforesaid range of note number data values "96" to "127" (corresponding to the tone pitch range C6 to G8) are tone colors depend on play style that is not associated with specific tone pitches. Further, the aforesaid range of note number data values "96" to "127" (corresponding to the tone pitch range C6 to G8) is a tone pitch range that is not usually used for generation of musical tone signals having tone pitches. In other words, the play style dependence tone colors that are not associated with specific tone pitches, such as strumming and fret noise, are assigned to note number data values representing tone pitches outside the tone pitch range that can be generated as musical tone signals having one specific tone pitch, for example, to note number data values representing tone pitches within a tone pitch range that cannot be generated in the relevant musical instrument. Therefore, the note number data can be effectively used without hindering the generation of musical tone signals having tone pitches.

Also, the aforesaid tone pitch range C6 to G8 (corresponding to note number data values "96" to "127") is further divided into plural tone pitch ranges, i.e. the tone pitch range C6 to D7 (corresponding to note number data values "96" to "110") and the tone pitch range D#7 to G8 (corresponding to note number data values "111" to "127"). Different play style dependence tone colors are respectively assigned to these divided tone pitch ranges C6 to D7 and D#7 to G8. Further, play style dependence tone colors having a little different tone colors in one kind of play style dependence tone color are respectively assigned to tone pitches within these divided tone pitch ranges C6 to D7 and D#7 to G8. Therefore, multiple kinds of play style dependence tone colors can be used, whereby variegated musical tone signals can be generated.

Next, a modified example of the above-mentioned embodiment will be described. In each area (i.e. each tone pitch range or each tone pitch) assigned to the note number data value in the above-described embodiment, different play style dependence tone colors may be assigned to different velocity data values. Namely, if for different velocity data values, different waveform data are prepared and area-corresponding data are prepared, more variegated musical tone signals can be generated.

Figure 8:
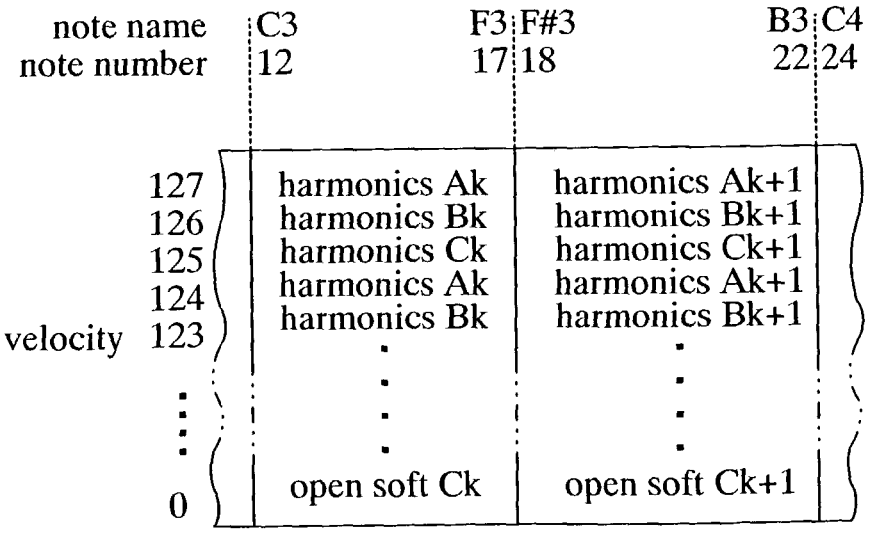
FIG. 8 is a view showing how play style dependence tone colors are assigned to velocities according to a modified example.

Particularly in this case, referring to FIG. 8, slightly different play style dependence tone colors Ak, Bk, Ck, and Ak+1, Bk+1, Ck+1 are assigned to slightly different velocity data values that are different from one another by "1", and waveform data and area-corresponding data are prepared in correspondence with the play style dependence tone colors. Moreover, slightly different play style dependence tone colors Ak, Bk, Ck, and Ak+1, Bk+1, Ck+1 may be assigned in a cyclic manner. This allows selective use of play style dependence tone colors having finely different tone colors at the time of reproducing the automatic performance data. For example, by changing the velocity data value in the note-on event data with a play operator such as a wheel or a slider, musical tone signals of play style dependence tone colors having finely different tone colors are randomly generated, thereby realizing natural music performance. Further, the velocity data value may be changed before reproduction of the automatic performance data, i.e. at the time of preparing or editing the automatic performance data.

Further, in the above-described embodiment, regarding play style dependence tone colors, waveform data and area data are prepared in the whole area of the "0" to "127" of the note number and "0" to "127" of the velocity. However, there are cases in which it is difficult in terms of costs to prepare waveform data and area data in the whole area such as this in lower-grade apparatus of electronic musical instrument even though this may be realized in upper-grade apparatus of electronic musical instrument.

In this case, the waveform data and area data regarding the area where they cannot be prepared may be substituted with other waveform data and area-corresponding data. However, one may omit the waveform data and area-corresponding data, regarding the area where they cannot be prepared, and the generation of the musical tone signals regarding the area may be made impossible. This facilitates the user's recognition of the absence of the waveform data and area-corresponding data regarding the area. Further, regarding the aforesaid area where the waveform data cannot be prepared, only the waveform data may be substituted with the waveform data of other areas, and the filter parameters, envelope parameters, and others constituting the area-corresponding data may be made different from those corresponding to the substituted waveform data.

Here, in the above-described embodiment, only the generation of musical tone signals based on the automatic performance data has been described; however, the musical tone signal generation according to the above-described embodiment can be applied to generation of musical tone signals according to real-time performance. In this case, the characteristic features of the above-described embodiment may be applied to the note number data and velocity data (data representing the strength of touch) according to operation of performance operator group 11 such as a keyboard.

Also, the present invention can be applied not only to electronic musical instruments but also to any electronic music apparatus as long as they are electronic music apparatus that can perform processing of programs such as a personal computer.

Further, in carrying out the present invention, it is not limited to the above-described embodiments or modifications thereof, so that various modifications can be made as long as they do not depart from the object of the present invention.

What is claimed is:

1. A musical tone generating apparatus comprising:

a musical tone signal generating circuit for generating a musical tone signal;

a musical tone signal generation controlling portion for inputting a first performance data that includes a note number data representing a tone pitch of the musical tone signal and a velocity data representing a tone volume level of the musical tone signal for giving instructions for generation of the musical tone signal and for controlling the generation of the musical tone signal in said musical tone signal generating circuit in accordance with the input first performance data; and a parameter memory for storing plural sets of musical tone generating parameters for respectively generating musical tone signals of tone colors corresponding to plural kinds of play style, said tone colors being different from one another in terms of play styles in one kind of musical instrument, said tone colors being respectively assigned to different values of said velocity data, wherein said musical tone signal generation controlling portion controls reading one set of musical tone generating parameters corresponding to a tone color that is assigned to a value of the velocity data in said input first performance data from said parameter memory and supplying the read one set of musical tone generating parameters to said musical tone signal generating circuit, so as to allow said musical tone signal generating circuit to generate a musical tone signal of the tone color corresponding to said read one set of musical tone generating parameters.

2. The musical tone generating apparatus according to claim 1, wherein the values of said velocity data are divided into plural ranges including plural different values, and different tone colors are respectively assigned to the divided plural ranges.

3. The musical tone generating apparatus according to claim 2, wherein said musical tone signal generation controlling portion includes a velocity data converting portion for converting the values of velocity data belonging to each range of said divided ranges to values representing tone volume levels of musical tone signals of tone colors corresponding to the range so as to supply the converted values to said musical tone signal generating circuit whereby the tone volume levels of the musical tone signals of the tone colors are controlled in accordance with said converted values representing the tone volume levels.

4. The musical tone generating apparatus according to claim 1, wherein each of the sets of musical tone generating parameters respectively corresponding to said tone colors is further made of plural sets of sub musical tone generating parameters respectively assigned to different values of said note number data, and said musical tone signal generation controlling portion controls reading one set of sub musical tone generating parameters that belongs to the one set of musical tone generating parameters assigned to the value of said velocity data and is assigned to a value of said note number data from said parameter memory.

5. A musical tone generating apparatus comprising:

a musical tone signal generating circuit for generating a musical tone signal;

a musical tone signal generation controlling portion for inputting a first performance data that includes a note number data representing a tone pitch of the musical tone signal and a velocity data representing a tone volume level of the musical tone signal for giving instructions for generation of the musical tone signal and a second performance data for selecting any one kind of musical instrument tone color from among plural kinds of musical instrument tone colors respectively corresponding to plural kinds of musical instruments and for controlling the generation of the musical tone signal in said musical tone signal generating circuit in accordance with the input first performance data and second performance data, and a parameter memory for storing plural sets of musical tone generating parameters prepared for each of said plural kinds of musical instrument tone colors for respectively generating musical tone signals of the tone colors corresponding to plural kinds of play style, said tone colors being different from one another in terms of play styles in one kind of musical instrument, and said tone colors being respectively assigned to different values of said velocity data, wherein said musical tone signal generation controlling portion controls reading one set of musical tone generating parameters corresponding to a tone color that belongs to a musical instrument tone color designated by said input second performance data and is assigned to a value of the velocity data in said input first performance data from said parameter memory and supplying the read one set of musical tone generating parameters to said musical tone signal generating circuit, so as to allow said musical tone signal generating circuit to generate a musical tone signal of the tone color corresponding to said read one set of musical tone generating parameters.

6. The musical tone generating apparatus according to claim 5, wherein the values of said velocity data are divided into plural ranges including plural different values, and different tone colors are respectively assigned to the divided plural ranges.

7. The musical tone generating apparatus according to claim 6, wherein said musical tone signal generation controlling portion includes a velocity data converting portion for converting the values of velocity data belonging to each range of said divided ranges to values representing tone volume levels of musical tone signals of tone colors corresponding to the range so as to supply the converted values to said musical tone signal generating circuit whereby the tone volume levels of the musical tone signals of the tone colors are controlled in accordance with said converted values representing the tone volume levels.

8. The musical tone generating apparatus according to claim 5, wherein each of the sets of musical tone generating parameters respectively corresponding to said tone colors is further made of plural sets of sub musical tone generating parameters respectively assigned to different values of said note number data, and said musical tone signal generation controlling portion controls reading one set of sub musical tone generating parameters that belongs to the one set of musical tone generating parameters assigned to the value of said velocity data and is assigned to a value of said note number data from said parameter memory.

9. A musical tone generating apparatus comprising:

a musical tone signal generating circuit for generating a musical tone signal;

a musical tone signal generation controlling portion for inputting a first performance data that includes at least a note number data representing a tone pitch of the musical tone signal for giving instructions for generation of the musical tone signal and for controlling the generation of the musical tone signal in said musical tone signal generating circuit in accordance with the input first performance data, and a parameter memory for storing plural sets of musical tone generating parameters for respectively generating musical tone signals of tone colors corresponding to plural kinds of play style, said tone colors being different from one another in terms of play styles in one kind of musical instrument, where some of the tone colors are assigned to values of note number data belonging to some range, while some other tone colors are assigned to values of note number data belonging to some other range, wherein said musical tone signal generation controlling portion controls reading one set of musical tone generating parameters corresponding to a tone color that is assigned to a value of the note number data in said input first performance data from said parameter memory and supplying the read one set of musical tone generating parameters to said musical tone signal generating circuit, so as to allow said musical tone signal generating circuit to generate a musical tone signal of the tone color corresponding to said read one set of musical tone generating parameters.

10. The musical tone generating apparatus according to claim 9, wherein said some other tone colors are tone colors of play style that is not associated with specific tone pitches, and the values of note number data belonging to said some other range represent tone pitches outside of a tone pitch range that can be generated as musical tone signals having one specific tone pitch.

11. The musical tone generating apparatus according of claim 9, wherein said other tone colors are made of plural kinds of play style dependent tone colors, wherein some other range includes plural different values of note number data, and wherein the plural kinds of play style dependent tone colors belonging to said other tone colors are respectively assigned to different values among the plural values of note number data belonging to said some other range.

12. The musical tone generating apparatus according of claim 9, wherein said first performance data includes a velocity data representing a tone volume level of the musical tone signal, at least one of said some tone colors and said some other tone colors are made of plural kinds of play style dependent tone colors, wherein the plural kinds of play style dependent tone colors belonging to said at least one of said some tone colors and said some other tone colors are respectively assigned to different values of said velocity data, and said musical tone signal generation controlling portion controls reading a musical tone generating parameter assigned to a value of the note number data in said input first performance data and assigned to a value of the velocity data in the first performance data among the plural sets of musical tone generating parameters respectively corresponding to the tone colors belonging to said at least one of said some play style dependent tone colors and said some other play style dependent tone colors from said parameter memory.

13. A musical tone generating apparatus comprising:

a musical tone signal generating circuit for generating a musical tone signal;

a musical tone signal generation controlling portion for inputting a first performance data that includes at least a note number data representing a tone pitch of the musical tone signal for giving instructions for generation of the musical tone signal and a second performance data for selecting any one kind of musical instrument tone color from among plural kinds of musical instrument tone colors respectively corresponding to plural kinds of musical instruments and for controlling the generation of the musical tone signal in said musical tone signal generating circuit in accordance with the input first performance data and second performance data, wherein a parameter memory for storing plural sets of musical tone generating parameters prepared for each of said plural kinds of musical instrument tone colors for respectively generating musical tone signals of tone colors corresnonding to plural kinds of play style, said tone colors being different from one another in terms of play styles in one kind of musical instrument, where some of the tone colors are assigned to values of note number data belonging to some range, while some other tone colors are assigned to values of note number data belonging to some other range, wherein said musical tone signal generation controlling portion controls reading one set of musical tone generating parameters corresponding to a tone color that belongs to a musical instrument tone color designated by said input second performance data and is assigned to a value of the note number data in said input first performance data from said parameter memory and supplying the read one set of musical tone generating parameters to said musical tone signal generating circuit, so as to allow said musical tone signal generating circuit to generate a musical tone signal of the tone color corresponding to said read one set of musical tone generating parameters.

14. The musical tone generating apparatus according to claim 13, wherein said some other tone colors are tone colors of play style that is not associated with specific tone pitches, and wherein the values of note number data belonging to said some other range represent tone pitches outside of a tone pitch range that can be generated as musical tone signals having one specific tone pitch.

15. The musical tone generating apparatus according to claim 13, wherein said other tone colors are made of plural kinds of play style dependent tone colors, wherein some other range includes plural different values of note number data, and wherein the plural kinds of play style dependent tone colors belonging to said other tone colors are respectively assigned to different values among the plural values of note number data belonging to said some other range.

16. The musical tone generating apparatus according to claim 13, wherein said first performance data includes a velocity data representing a tone volume level of the musical tone signal, at least one of said some tone colors and said some other tone colors are made of plural kinds of play style dependent tone colors, the plural kinds of play style dependent tone colors belonging to said at least one of said some tone colors and said some other tone colors are respectively assigned to different values of said velocity data, and said musical tone signal generation controlling portion controls reading a musical tone generating parameter assigned to a value of the note number data in said input first performance data and assigned to a value of the velocity data in the first performance data among the plural sets of musical tone generating parameters respectively corresponding to the plural kinds of play style dependent tone colors belonging to said at least one of said some tone colors and said some other tone colors from said parameter memory.

17. A musical tone generating computer program for a musical tone generating apparatus comprising a musical tone signal generating circuit that generates a musical tone signal, a parameter memory that stores plural sets of musical tone generating parameters for respectively generating musical tone signals of tone colors corresponding to plural kinds of play style, said tone colors being different from one another in terms of play styles in one kind of musical instrument, and a computer that controls generation of the musical tone signal in said musical tone signal generating circuit in accordance with a first performance data that includes a note number data representing a tone pitch of the musical tone signal and a velocity data representing a tone volume level of the musical tone signal for giving instructions for the generation of the musical tone signal, where said tone colors are respectively assigned to different values of said velocity data, said musical tone generating computer program being applied to said computer of said musical tone generating apparatus, for causing the musical tone generating apparatus to perform the steps of:

inputting said first performance data; and controlling reading one set of musical tone generating parameters corresponding to a tone color that is assigned to a value of the velocity data in said input first performance data from said parameter memory and supplying the read one set of musical tone generating parameters to said musical tone signal generating circuit, so as to allow said musical tone signal generating circuit to generate a musical tone signal of the tone color corresponding to said read one set of musical tone generating parameters.

18. A musical tone generating computer program for a musical tone generating apparatus comprising a musical tone signal generating circuit that generates a musical tone signal, a parameter memory that stores plural sets of musical tone generating parameters prepared for each of plural kinds of musical instrument tone colors respectively corresponding to plural kinds of musical instruments for respectively generating musical tone signals of tone colors corresponding to plural kinds of play style, said tone colors being different from one another in terms of play styles in one kind of musical instrument, and a computer that controls generation of the musical tone signal in said musical tone signal generating circuit in accordance with a first performance data that includes a note number data representing a tone pitch of the musical tone signal and a velocity data representing a tone volume level of the musical tone signal for giving instructions for the generation of the musical tone signal and a second performance data for selecting any one kind of musical instrument tone color from among said plural kinds of musical instrument tone colors, where said tone colors are respectively assigned to different values of said velocity data, said musical tone generating computer program being applied to said computer for causing the musical tone generating apparatus for causing the musical tone generating apparatus to perform the steps of:

inputting said first performance data and said second performance data; and controlling reading one set of musical tone generating parameters corresponding to a tone color that belongs to a musical instrument tone color designated by said input second performance data and is assigned to a value of the velocity data in said input first performance data from said parameter memory and supplying the read one set of musical tone generating parameters to said musical tone signal generating circuit, so as to allow said musical tone signal generating circuit to generate a musical tone signal of the tone color corresponding to said read one set of musical tone generating parameters.

19. A musical tone generating computer program for a musical tone generating apparatus comprising a musical tone signal generating circuit that generates a musical tone signal, a parameter memory that stores plural sets of musical tone generating parameters for respectively generating musical tone signals of tone colors corresponding to plural kinds of play style, said tone colors being different from one another in terms of play styles in one kind of musical instrument, and a computer that controls generation of the musical tone signal in said musical tone signal generating circuit in accordance with a firstperformance data that includes at least a note number data representing a tone pitch of the musical tone signal for giving instructions for the generation of the musical tone signal, where some of the tone colors are assigned to values of note number data belonging to some range, while some other tone colors are assigned to values of note number data belonging to some other range, said musical tone generating computer program being applied to said computer of said musical tone generating apparatus for causing the musical tone generating apparatus to perform the steps of:

inputting said first performance data; and controlling reading one set of musical tone generating parameters corresponding to a tone color that is assigned to a value of the note number data in said input first performance data from said parameter memory and supplying the read one set of musical tone generating parameters to said musical tone signal generating circuit, so as to allow said musical tone signal generating circuit to generate a musical tone signal of the tone color corresponding to said read one set of musical tone generating parameters.

20. A musical tone generating computer program for a musical tone generating apparatus comprising a musical tone signal generating circuit that generates a musical tone signal, a parameter memory that stores plural sets of musical tone generating parameters prepared for each of plural kinds of musical instrument tone colors respectively corresponding to plural kinds of musical instruments for respectively generating musical tone signals of tone colors corresponding to plural kinds of play style, said tone colors being different from one another in terms of play styles in one kind of musical instrument, and a computer that controls generation of the musical tone signal in said musical tone signal generating circuit in accordance with a first performance data that includes at least a note number data representing a tone pitch of the musical tone signal for giving instructions for the generation of the musical tone signal and a second performance data for selecting any one kind of musical instrument tone color from among said plural kinds of musical instrument tone colors, where some tone colors are assigned to values of note number data belonging to some range, while some other tone colors are assigned to values of note number data belonging to some other range, said musical tone generating computer program being applied to said computer of said musical tone generating apparatus for causing the musical tone generating apparatus to perform the steps of:

inputting said first performance data and said second performance data; and controlling reading one set of musical tone generating parameters corresponding to a tone color that belongs to a musical instrument tone color designated by said input second performance data and is assigned to a value of the note number data in said input first performance data from said parameter memory and supplying the read one set of musical tone generating parameters to said musical tone signal generating circuit, so as to allow said musical tone signal generating circuit to generate a musical tone signal of the tone color corresponding to said read one set of musical tone generating parameters.

21. A musical tone generating apparatus comprising:

a musical tone signal generating circuit for reading waveform data from a waveform memory and for generating a musical tone signal based on the waveform data; and a musical tone signal generation controlling portion for inputting a first performance data that includes a note number data representing a tone pitch of the musical tone signal and a velocity data representing a tone volume level of the musical tone signal for giving instructions for generation of the musical tone signal and a second performance data for selecting any one kind of musical instrumeni tone color from among plural kinds of musical instrument tone colors respectively corresponding to plural kinds of musical instruments and for controlling the generation of the musical tone signal in said musical tone signal generating circuit in accordance with the input first performance data and second performance data, wherein said waveform data memory stores plural waveform data prepared for each of said plural kinds of musical instrument tone colors for respectively generating musical tone signals of tone colors corresponding to plural kinds of play styles, said tone colors being different from one another in terms of play styles in one kind of musical instrument, and said tone colors being respectively assigned to different values of said velocity data, and said musical tone signal generation controlling portion controls said musical tone signal generating circuit to read waveform data corresponding to a tone color that belongs to a musical instrument tone color designated by said input second performance data and is assigned to a value of the velocity data in said input first performance data from said waveform data memory so that said musical tone signal generating circuit generates a musical tone signal of the tone color corresponding to a kind of play style.

22. A musical tone generating apparatus comprising:

a musical tone signal generating circuit for reading waveform data from a waveform memory and for generating a musical tone signal based on the waveform data; and a musical tone signal generation controlling portion for inputting a first performance data that includes at least a note number data representing a tone pitch of the musical tone signal for giving instructions for generation of the musical tone signal and a second performance data for selecting any one kind of musical instrument tone color from among plural kinds of musical instrument tone colors respectively corresponding to plural kinds of musical instruments and for controlling the generation of the musical tone signal in said musical tone signal generating circuit in accordance with the input first performance data and second performance data, wherein said waveform data memory stores plural waveform data prepared for each of said plural kinds of musical instrument tone colors for respectively generating musical tone signals of tone colors corresponding to plural kinds of play styles, said tone colors being different from one another in terms of play styles in one kind of musical instrument, where some of the tone colors are assigned to values of note number data belonging to some range, while some other tone colors are assigned to values of note number data belonging to some other range, and wherein said musical tone signal generation controlling portion controls said musical tone signal generating circuit to read waveform data corresponding to a tone color that belongs to a musical instrument tone color designated by said input second performance data and is assigned to a value of the note number data in said input first performance data, from said waveform data memory so that said musical tone signal generating circuit generates a musical tone signal of the tone color corresponding to a kind of play style.

23. A musical tone generating apparatus comprising:

a musical tone signal generating circuit for reading waveform data from a waveform memory and for generating a musical tone signal based on the waveform data; and a musical tone signal generation controlling portion for inputting a first performance data that includes a note number data representing a tone pitch of the musical tone signal and a velocity data representing a tone volume level of the musical tone signal for giving instructions for generation of the musical tone signal and for controlling the generation of the musical tone signal in said musical tone signal generating circuit in accordance with the input first performance data, wherein said waveform data memory stores plural waveform data for generating musical tone signals of tone colors corresponding to plural kinds of play styles, said tone colors being different from one another in terms of play styles in one kind of musical instrument, and said tone colors being respectively assigned to different values of said velocity data, and said musical tone signal generation controlling portion controls said musical tone signal generating circuit to read waveform data corresponding to a tone color that is assigned to a value of the velocity data in said input first performance data from said waveform data memory so that said musical tone signal generating circuit generates a musical tone signal of the tone color corresponding to a kind of play style.

24. A musical tone generating apparatus comprising:

a musical tone signal generating circuit for reading waveform data from a waveform memory and for generating a musical tone signal based on the waveform data; and a musical tone signal generation controlling portion for inputting a first performance data that includes at least a note number data representing a tone pitch of the musical tone signal for giving instructions for generation of the musical tone signal and for controlling the generation of the musical tone signal in said musical tone signal generating circuit in accordance with the input first performance data, wherein said waveform data memory stores plural waveform data for generating musical tone signals of tone colors corresponding to plural kinds of play styles, said tone colors being different from one another in terms of play styles in one kind of musical instrument, where some of the tone colors are assigned to values of note number data belonging to some range, while some other tone colors are assigned to values of note number data belonging to some other range, and wherein said musical tone signal generation controlling portion controls said musical tone signal generating circuit to read waveform data corresponding to a tone color that is assigned to a value of the note number data in said input first performance data from said waveform data memory so that said musical tone signal generating circuit generates a musical tone signal of the tone color corresponding to a kind of play style.

* * * * *